US010088289B2

(12) United States Patent
Wilton

(10) Patent No.: US 10,088,289 B2
(45) Date of Patent: Oct. 2, 2018

(54) IGNITER DEVICE

(71) Applicant: BAE SYSTEMS plc, London (GB)

(72) Inventor: Anne Marie Wilton, Strathclyde (GB)

(73) Assignee: BAE Systems PLC, London (GB)

( * ) Notice: Subject to any disclaimer, the term of this patent is extended or adjusted under 35 U.S.C. 154(b) by 1 day.

(21) Appl. No.: 14/905,395

(22) PCT Filed: Jul. 14, 2014

(86) PCT No.: PCT/GB2014/052137
§ 371 (c)(1),
(2) Date: Jan. 15, 2016

(87) PCT Pub. No.: WO2015/008045
PCT Pub. Date: Jan. 22, 2015

(65) Prior Publication Data

US 2016/0161235 A1 Jun. 9, 2016

(30) Foreign Application Priority Data

Jul. 16, 2013 (EP) ..... 13275166
Jul. 16, 2013 (GB) ..... 1312693.3

(51) Int. Cl.
*F42C 19/08* (2006.01)
*F42B 33/00* (2006.01)

(52) U.S. Cl.
CPC ..... *F42C 19/0838* (2013.01); *F42B 33/001* (2013.01); *F42C 19/0815* (2013.01); *F42C 19/0823* (2013.01)

(58) Field of Classification Search
CPC ..... F42B 33/001; F42C 19/0815; F42C 19/0823; F42C 19/0838
(Continued)

(56) References Cited

U.S. PATENT DOCUMENTS 864,725 A * 8/1907 Davis ..... F42B 14/04 102/282
3,224,373 A * 12/1965 Kramer ..... F42C 19/0819 102/202

(Continued)

FOREIGN PATENT DOCUMENTS

DE 3810355 A1 10/1989
FR 2725781 A1 * 4/1996 ..... F42C 19/0826
WO 2015008045 A1 1/2015

OTHER PUBLICATIONS

International Preliminary Report on Patentability received for Patent Application No. PCT/GB2014/052137, dated Jan. 28, 2016. 7 pages.

(Continued)

*Primary Examiner* — Stephen Johnson
*Assistant Examiner* — Benjamin S Gomberg
(74) *Attorney, Agent, or Firm* — Finch & Maloney PLLC

(57) ABSTRACT

The invention relates to an igniter device for igniting energetic materials, more specifically to the area of the initiation of munitions, and methods of forming said ignition devices. There is provided an igniter device, for use in an explosive train, comprising a first synthetic polymer layer, a second synthetic polymer layer, wherein said first layer and second layer envelope a portion of an energetic material, wherein said synthetic polymer is capable of being sealed.

16 Claims, 5 Drawing Sheets

Figures 1A, 1B, 1C:
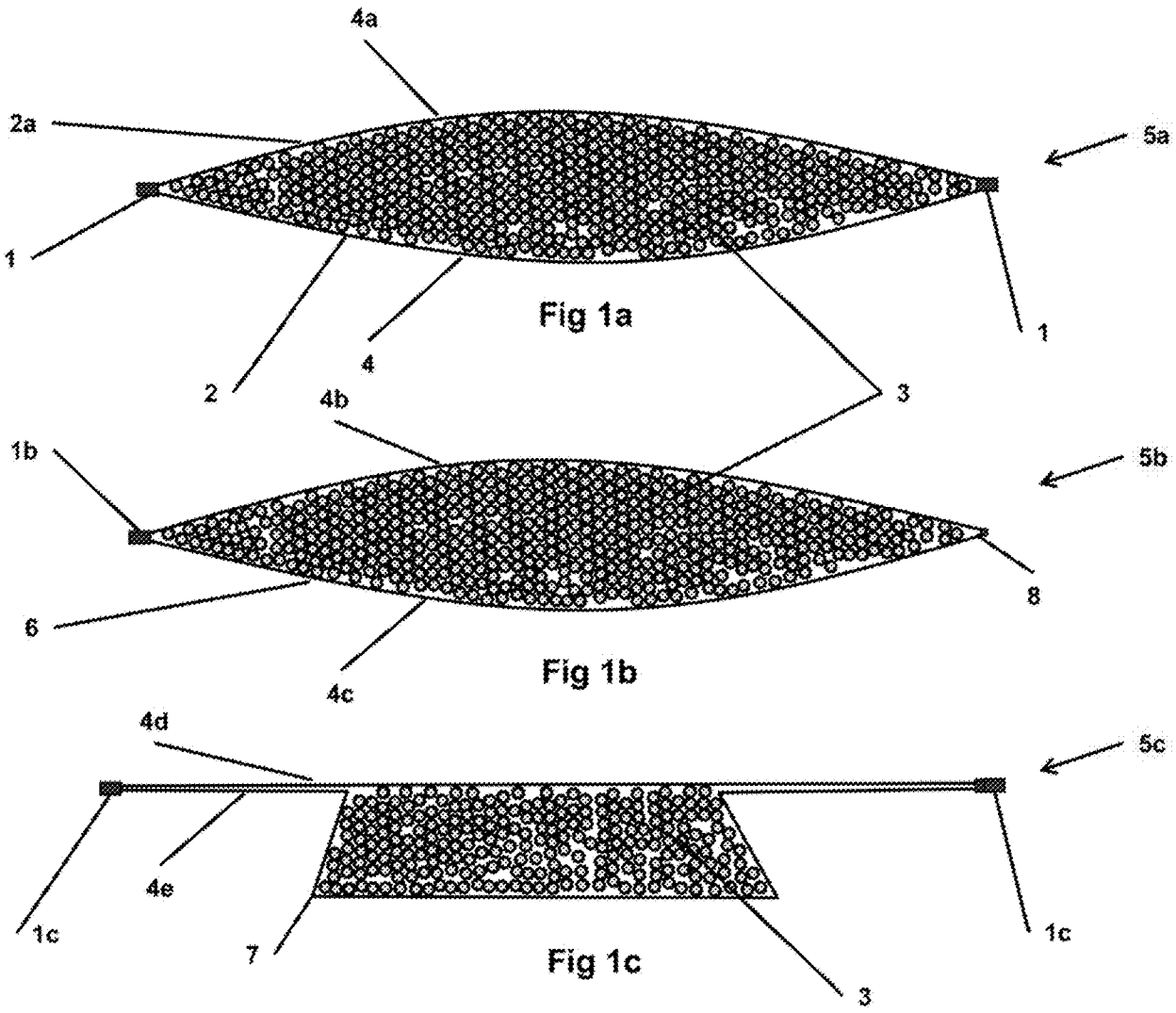

(58) Field of Classification Search
USPC ..... 102/202.12, 275.11–275.12
See application file for complete search history.

(56) References Cited

U.S. PATENT DOCUMENTS

| | | | | | |
|---|---|---|---|---|---|
| 4,040,796 | A * | 8/1977 | Vincent | C10L 5/44 | 44/519 |
| 5,063,848 | A * | 11/1991 | Tucker | F42B 5/16 | 102/282 |
| 5,269,224 | A * | 12/1993 | Gonzales | F42B 5/16 | 102/275.11 |
| 5,959,233 | A * | 9/1999 | Garcia | B63G 7/02 | 102/403 |
| 7,891,297 | B1 * | 2/2011 | Rohr | F42B 12/02 | 102/265 |

OTHER PUBLICATIONS

International Search Report and Written Opinion received for Patent Application No. PCT/GB2014/052137, dated Aug. 22, 2014. 10 pages.
GB Intellectual Property Office Search Report under Section 17(5) received for GB Patent Application No. 1312693.3 dated Dec. 19, 2013. 3 pages.
Extended European Search Report received for EP Patent Application No. 13275166.0 dated Dec. 11, 2013. 6 pages.

* cited by examiner 5a
1
3
4a
4
2
2a
1

5b
8
4b
4c
1b
6

5c
1c
3
7
4d
4e
1c

IGNITER DEVICE

The invention relates to an igniter device for igniting energetic materials, more specifically to the area of the initiation of munitions, and methods of forming said ignition devices.

Within the field of munitions an explosive train sequence may comprise a primer, an igniter with intermediate explosive and an output charge such as, for example a propellant. The explosive train serves to take a small energetic event and amplify the output as it moves through the explosive train, meaning a primer is typically a small amount of highly sensitive material contained within an item such as, for example a percussion cap allowing ignition via an explosive train to initiate an intermediate, such as gunpowder which in turn sets of the energetic propellant formulation which is typically a larger volume of material which takes a larger input stimulus to initiate.

The construction of igniters for use in conventional base ignited propelling charge currently requires pouring a set quantity of energetic material into pre-machined cotton primer bags, which are then hand sewn to encase the energetic material. Hand sewing is considered a requirement as faster methods such as machine sewing or stapling present a risk of initiating the material and may not provide an adequate seal to contain the energetic material.

According to a first aspect of this invention there is provided an igniter device, for use in an explosive train, comprising a first synthetic polymer layer, a second synthetic polymer layer, wherein said first layer and second layer envelope a portion of an energetic material, wherein said polymers are capable of being sealed; such that said first and second layers are sealed together.

In relation to the igniter device a synthetic polymer layer is considered to be a man-made polymer, such as, for example thermoplastics or thermosets. The term layer maybe a sheet of said synthetic polymer, whether it is in the form of a flat, unmoulded synthetic polymer sheet or a preformed synthetic polymer sheet.

To envelope the energetic material, a single sheet of polymer may be is folded over on itself to an edge in order for the seal to take effect and provide a first and second layer so as to prevent the escape of energetic material.

The energetic material maybe a material such as a pyrotechnic, propellant or high explosive composition, however for ignition it is preferable that the energetic material is a propellant or pyrotechnic.

The construction of prior art cotton primer bags presents a number of issues. Firstly the process requires the construction and filling of cotton pouches, which is costly in terms of time. Secondly the sealing of the pouches requires hand sewing, increasing the workload on people and the time of production and finally the cotton primer bags are of set dimensions with no devices included to separate the energetic material location within the cotton primer bag. This potentially means that the energetic material may disperse, during transport, to one area of the cotton primer bag leading to an inefficient burn or even failure to cause initiation.

The use of a synthetic polymer allows greater control and flexibility over the igniter device's shape, and speeds up the process of manufacture by providing mechanised methods of sealing the ignition device compared to hand sewing. Preferably the seal is caused by the application of pressure, heat, or UV, though mechanical fastenings or an adhesive may be used in combination, although certain adhesives can cause compatibility problems with certain energetic materials and are preferably avoided. Preferably the synthetic polymer material 'self-seals' when caused to flow or partially melt by the application of heat, UV or pressure, the seal is created when the fused first and second layers re solidify. This essentially allows the igniter device to be adapted to its requirements by shaping the synthetic polymer to form the layers required, such as for a base pad igniter or wrapping a sheet version of the igniter device into a cylindrical central core igniter shape to fit within a propellant charge central cavity or, a replacement to metal primer designs for metal cartridges.

The energetic material may be prevented from moving within the envelope to ensure more consistent distribution in the final device. This may be achieved by preferably providing at least one separator structure, to provide at least two segments once the device is sealed. This will prevent the energetic material from collecting in one area of the device if it is moved and may allow for a more uniform dispersion of the explosive energy output. Further to this, the inclusion of a separator structure provides the opportunity to use more than one energetic material within the same ignition device, potentially adding an additional step in the explosive train sequence. This may make the primer more adaptable for use in munitions requiring a different explosive train sequence.

The energetic material may be prevented from dispersing by vacuum packing, such that the igniter device may be sealed under vacuum such that there are no air gaps and the synthetic polymer grips or retains the energetic material.

The separation of the energetic material may preferably be achieved by the use of at least one polymer separator structure separator structure, or during the manufacturing process by utilising the advantage of sealing or crimping the igniter device at areas throughout the device, such that at least one of the first or second synthetic polymer layers forms a separator structure during the sealing process. Separator structures separate the energetic material and they may also provide the igniter device with a more rigid structure. As a result the separation structures may be internal, or where reinforcement only is required splines or rigid members may be mounted externally to the igniter device; or both if required.

To provide a more uniform explosive energy output the device may comprise a plurality of through holes where there is a clear hole from one side of the device through to the other. This provides a number of areas which will provide paths for thermal output and flame propagation, allowing the device to utilise the areas created by the separator structures or through holes to ensure an even ignition of the next energetic material.

The igniter device synthetic polymer layers may be produced as one or more preformed synthetic polymer sheets. This may allow a faster method of construction by using a preformed synthetic polymer sheet containing a recess as part of the first layer and enveloping the energetic material with a synthetic polymer sheet to create a second layer or by using a preformed synthetic polymer sheet to create the second layer. Once the energetic material has been enveloped between the first and second layers the synthetic polymer sheets may be sealed together.

The first synthetic polymer layer may be prepared as a preformed shape, such that it is formed into a 3 dimensional shape, such as, for example to be able to adopt to the shape of an internal cavity within a munition or to provide a pocket, or recess in which the energetic material is located. The second synthetic polymer layer may simply be in the form of a sheet and sealed to form the final igniter device.

In a further arrangement both the first and second synthetic polymer layers may be selected from preformed shapes, which may be slotted together leaving a void which can be filled with energetic material, the void may be filled via a fill portal and may be joined via a sealable joining seam, or the fill portal may be the sealable joining seam.

The use of a preformed first or second synthetic polymer layer and/or separator structures may provide a degree of rigidity, which may provide structural support for the energetic materials within the munition.

According to a yet further aspect of this invention there is provided a method of forming an igniter device as defined herein comprising the steps of preparing a synthetic polymer layer and adding an energetic material onto the synthetic polymer layer and folding said synthetic polymer layer over itself, such as to form first and second synthetic polymer layers that the said energetic material is enveloped inside the first synthetic polymer layer and sealing said synthetic polymer layers, such that the said energetic material is enveloped.

According to a yet further aspect of this invention there is provided a method of forming an igniter device as defined herein comprising the steps of preparing a first synthetic polymer layer and adding an energetic material onto a first synthetic polymer layer and enveloping said energetic material with a second synthetic polymer layer, sealing the said first and second synthetic polymer layers, such that the said energetic material is enveloped. In a preferred arrangement at least one of the first or second layers are preformed into a final configuration.

Whilst the invention has been described above, it extends to any inventive combination of the features set out above, or in the following description, drawings or claims.

Exemplary embodiments of the device in accordance with the invention will now be described with reference to the accompanying drawings in which:

FIGS. 1*a, b* and *c* show a number of cross sections of various embodiments of the igniter device.

Figures 2A, 2B, 2C:
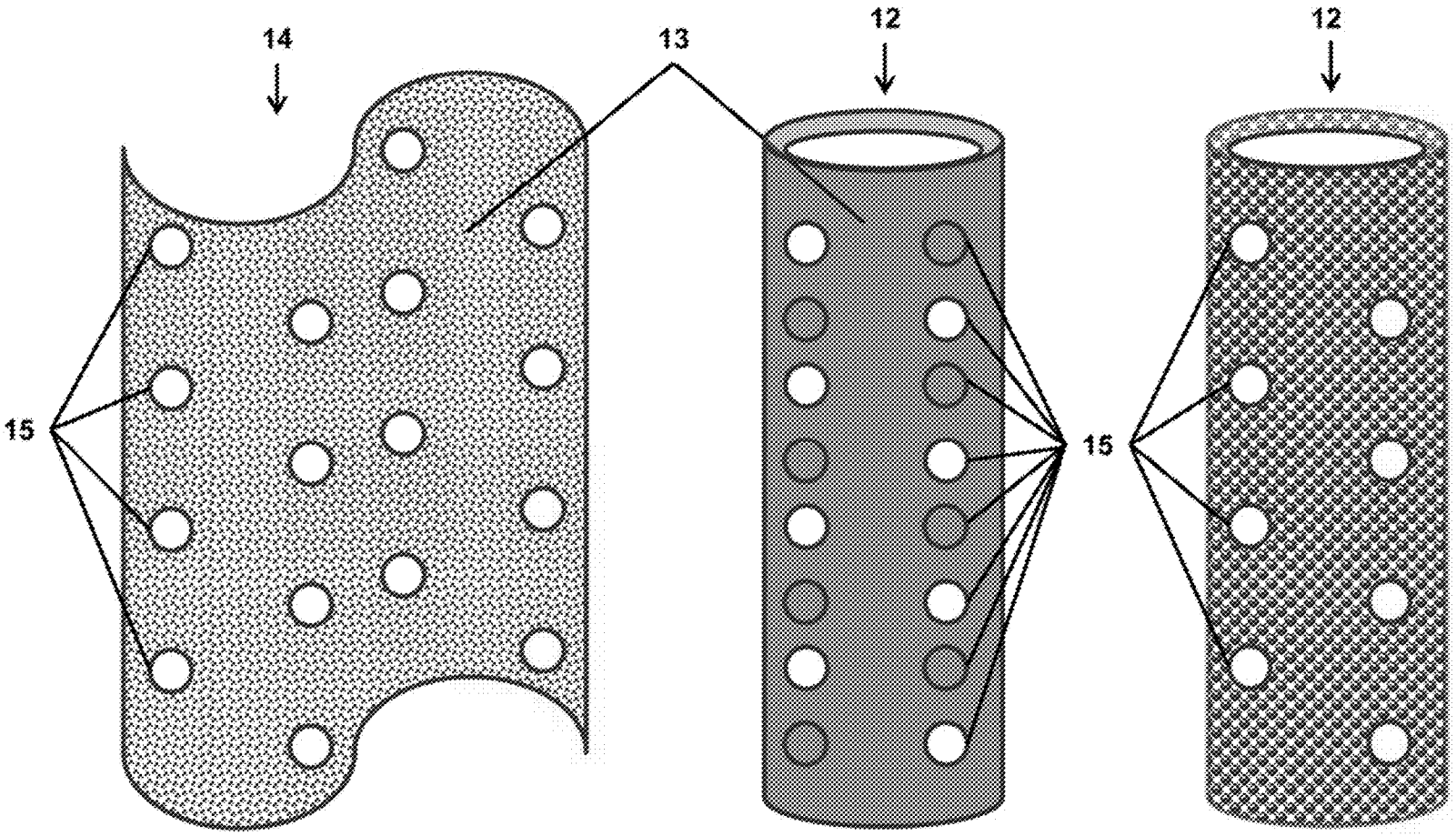

FIGS. 2*a*, 2*b* and 2*c* show a view of the igniter device in sheet form, rolled into a cylindrical shape and including a plurality of through holes.

Figure 3B:
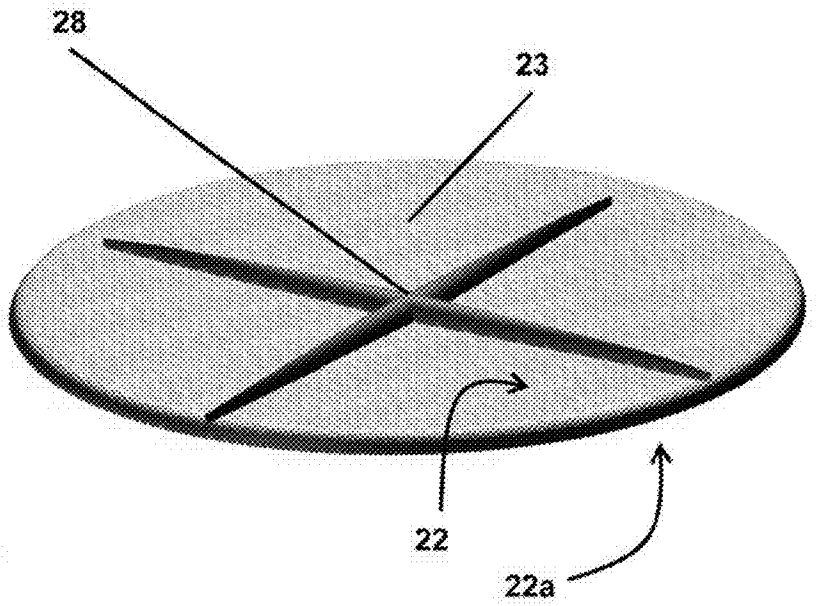
Figure 3A:
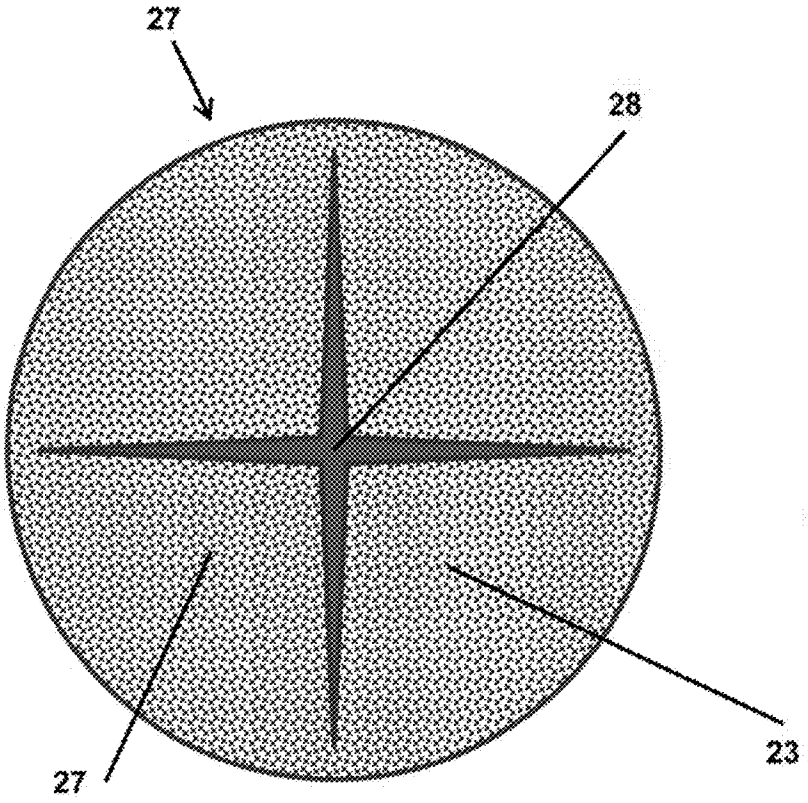

FIGS. 3*a* and 3*b* show a view of the igniter device as a base pad igniter including separator structures.

Figures 4A, 4B:
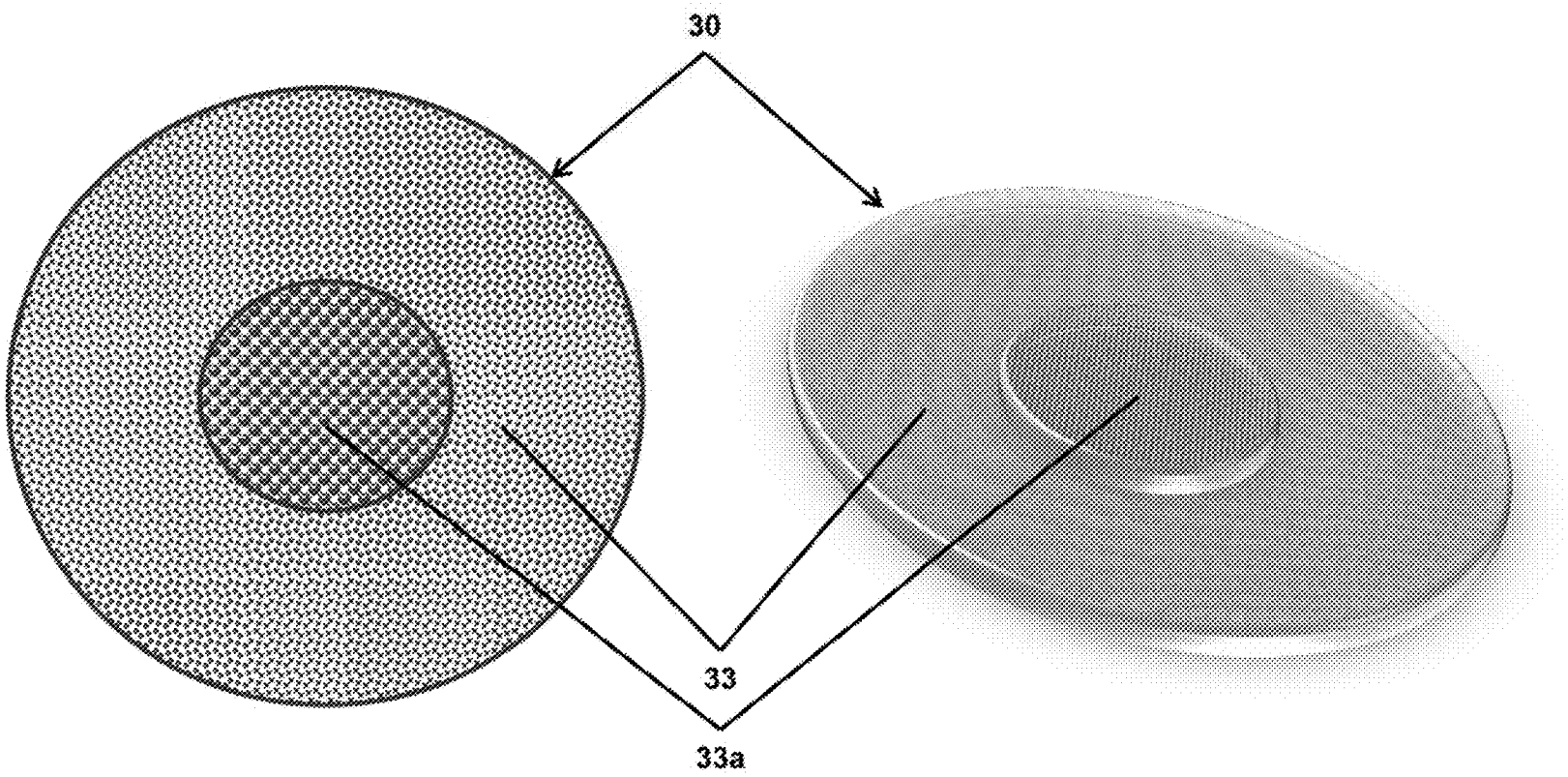

FIGS. 4*a* and 4*b* show a view of the igniter device as a base pad consisting of more than one energetic material.

Figure 5:
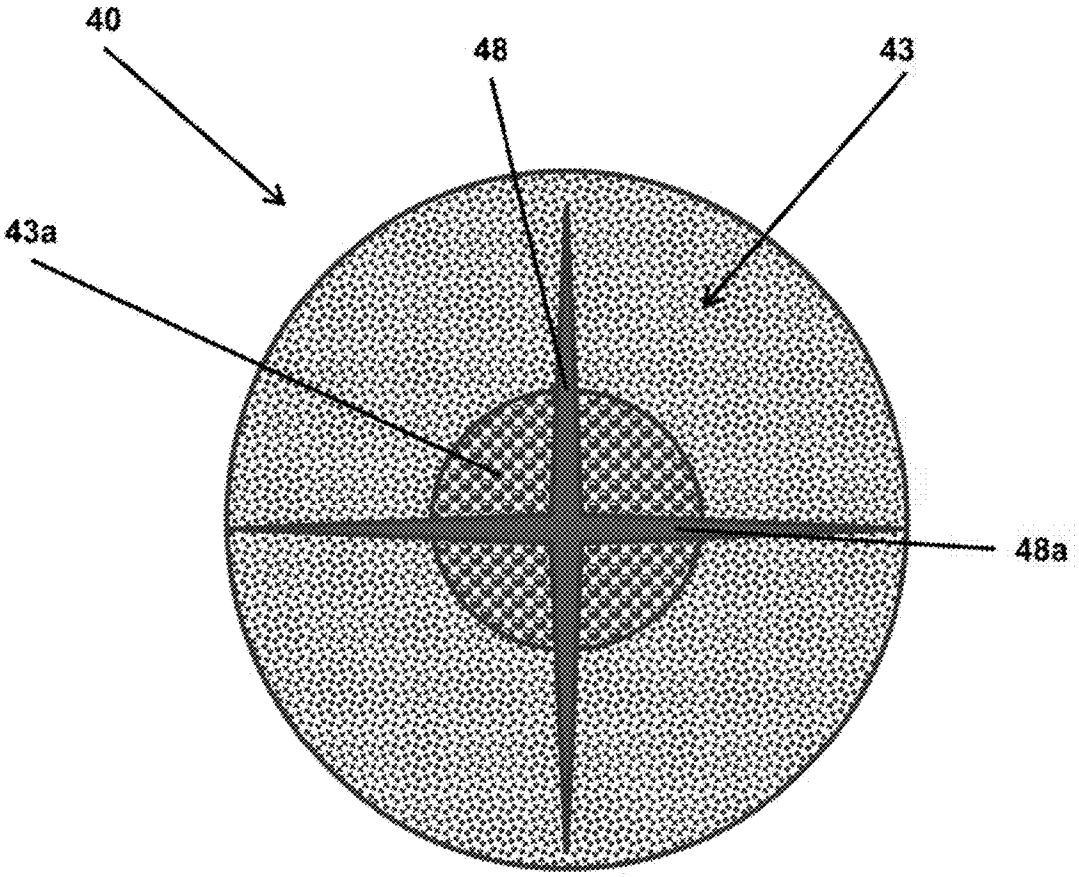

FIG. 5 shows a view of the igniter device moulded into a shape and incorporates multiple layers as well as more than one energetic material.

Referring to FIGS. 1*a, b* and *c* there shows a cross section of the igniter device 5*a*; FIG. 1*a* shows the device 5*a* with a synthetic polymer sheet 2 providing the first synthetic polymer layer 4 with an energetic material 3 encased between the first synthetic polymer layer 4 and a second synthetic polymer sheet 2*a*, which makes up the second synthetic polymer layer 4*a*, wherein said layers of synthetic polymer 4, 4*a* are sealed 1 together by application of heat, pressure or UV.

FIG. 1*b* shows an alternative embodiment of the igniter device as a cross section 5*b* where a single sheet of synthetic polymer 6 has been used to create a first synthetic polymer layer 4*c*, but has been wrapped over itself to encase the energetic material 3 and to be sealed 1*b* at an edge, giving it both a first layer 4*c* and a second synthetic polymer layer 4*b*. A sealed edge 1*b* is created at one side of the igniter device and a fold 8 is present at the other.

FIG. 1*c* shows an embodiment of the device 5*c* where the first synthetic polymer layer 4*e* is preformed 7 and contains the energetic material 3. A second synthetic polymer layer 4*d* is placed on top to cover and is sealed 1*c*.

Referring to FIGS. 2*a*, 2*b* and 2*c* there is provided a central core igniter synthetic polymer sheet with a plurality of holes 15. The energetic material 13 is encased between two synthetic polymer sheets as shown in FIGS. 2*a*, 2*b* and 2*c*. In this figure the synthetic polymer sheet is shown in both a flat sheet embodiment 14 and a cylindrical form 12. In the cylindrical form the centre remains hollow and the outer synthetic polymer layer is rigid and may be inserted into a propellant cavity.

Referring to FIGS. 3*a* and 3*b* which shows a base pad 27 igniter, the synthetic polymer sheet 24 has been manufactured in the form of a circle, consisting of two layers 22, 22*a*, with the energetic material 23 encased between the layers 22, 22*a*. The separator structures 28 can be seen dividing the energetic material into four segments and can contain energetic material if required and provides rigidity to the base pad igniter device 27.

Referring to FIGS. 4*a* and 4*b* there is a base pad igniter 30 which consists of two separate areas of different energetic materials 33, 33*a*. This configuration allows two energetic materials 33, 33*a* to be arranged in a base pad igniter to control the output of the explosive train.

Referring to FIG. 5 there is an igniter device 40 with two types of energetic material 43, 43*a* stacked on top of each other, though further energetic materials may be included if required. The separator structures 48 divide the energetic material into four segments; again additional segments may be created by including further separator structures or by sealing the device at desired locations. The separator structures 48, 48*a* in this embodiment have an added advantage of providing a more rigid structure for the igniter device.

The invention claimed is:

1. An igniter device, comprising:

a first synthetic polymer layer having a first plurality of holes extending therethrough; and a second synthetic polymer layer having a second plurality of holes extending therethrough, wherein the first synthetic polymer layer and the second synthetic polymer layer envelope a portion of an energetic material, wherein the first and second plurality of holes form clear holes from one side of the igniter device through to another side of the igniter device while the first and the second synthetic polymer layers envelop the portion of the energetic material without causing leakage of the energetic material, and wherein the first and second synthetic polymer layers each comprise a synthetic polymer material that is capable of being sealed.

2. The igniter device according to claim 1, wherein the synthetic polymer material self-seals when caused to flow or partially melt by application of at least one of heat, ultraviolet (UV) radiation, and pressure, thereby sealing the first and second synthetic polymer layers.

3. The igniter device according to claim 1, further comprising at least one rigid internal separator structure formed from a polymer and configured to divide the enveloped portion of the energetic material into at least two segments once the first and second synthetic polymer layers are sealed.

4. The igniter device according to claim 1, wherein the first synthetic polymer layer is a preformed shape.

5. The igniter device according to claim 1, wherein the first and second synthetic polymer layers are preformed shapes, further comprising a fill portal and a sealable joining seam.

6. A munition comprising at least one igniter device according to claim 1.

7. The igniter device according to claim 1, wherein the second synthetic polymer layer is formed from one of a portion of the first synthetic polymer layer folded over itself and a separate synthetic polymer layer.

8. The igniter device according to claim 1, further comprising a third synthetic polymer layer, wherein the second and third synthetic polymer layers envelop another portion of the energetic material.

9. The igniter device according to claim 8, wherein the portion of the energetic material enveloped by the second and third synthetic polymer layers is stacked on top of the portion of the energetic material enveloped by the first and second synthetic polymer layers.

10. The igniter device according to claim 9, wherein the portion of the energetic material enveloped by the second and third synthetic polymer layers is a different type of material than the portion of the energetic material enveloped by the first and second synthetic polymer layers.

11. The igniter device according to claim 10, wherein at least one of the portion of the energetic material enveloped by the second and third synthetic polymer layers and the portion of the energetic material enveloped by the first and second synthetic polymer layers is a loose powder.

12. A method of forming an igniter device, the method comprising:

preparing a first synthetic polymer layer having a first plurality of holes extending therethrough;

adding an energetic material onto the first synthetic polymer layer;

forming an envelope about the energetic material with a second synthetic polymer layer having a second plurality of holes extending therethrough, wherein the second synthetic polymer layer is one of a portion of the first synthetic polymer layer folded over itself and a separate synthetic polymer layer, wherein the first and second plurality of holes form clear holes from one side of the igniter device through to another side of the igniter device while the first and the second synthetic polymer layers envelop the energetic material without causing leakage of the energetic material;

forming, within the envelope, at least one rigid internal separator from at least one polymer to divide the envelope into at least two segments; and sealing the at least one rigid internal separator between the first and second synthetic polymer layers.

13. The method according to claim 12 wherein the sealing is performed under a vacuum.

14. The method according to claim 12, wherein the sealing is performed by application of at least one of heat, ultraviolet (UV) radiation, and pressure.

15. An igniter device, comprising:

a first synthetic polymer layer;

a second synthetic polymer layer; and a third synthetic polymer layer, wherein the first and second synthetic polymer layers envelop a first energetic material, wherein the second and third synthetic polymer layers envelop a second energetic material, wherein the enveloped second energetic material is stacked on top of the enveloped first energetic material, wherein each of the first, second and third synthetic polymer layers comprise a synthetic polymer material that is capable of being sealed, wherein at least one of the first, second and third synthetic polymer layers forms a rigid internal separator structure configured to divide the enveloped first energetic material into at least two segments once the first and second synthetic polymer layers are sealed, wherein the first energetic material is a different type of material than the second energetic material, and wherein at least one of the portion of the energetic material enveloped by the second and third synthetic polymer layers and the portion of the energetic material enveloped by the first and second synthetic polymer layers is a loose powder.

16. The igniter device according to claim 15, wherein the synthetic polymer material self-seals when caused to flow or partially melt by application of at least one of heat, ultraviolet (UV) radiation, and pressure, thereby sealing the first, second and third synthetic polymer layers.

* * * * *